United States Patent [19]

Yabe

[11] Patent Number: 4,812,246

[45] Date of Patent: Mar. 14, 1989

[54] BASE OIL FOR LUBRICATING OIL AND LUBRICATING OIL COMPOSITION CONTAINING SAID BASE OIL

[75] Inventor: Takao Yabe, Ichihara, Japan

[73] Assignee: Idemitsu Kosan Co., Ltd., Tokyo, Japan

[21] Appl. No.: 160,027

[22] Filed: Feb. 25, 1988

[30] Foreign Application Priority Data

Mar. 12, 1987 [JP] Japan ..... 62-55310
Mar. 12, 1987 [JP] Japan ..... 62-55311

[51] Int. Cl.[4] ..... C10M 137/06

[52] U.S. Cl. ..... 252/32.7 E; 252/35; 252/42.7; 252/48.2; 252/52 R; 252/46.4; 208/18

[58] Field of Search ..... 208/18; 252/35, 46.4, 252/32.7 E, 42.7, 48.2, 52 R

[56] References Cited

U.S. PATENT DOCUMENTS 4,178,258 12/1979 Papay et al. ..... 252/33.6
4,229,282 10/1980 Peters et al. ..... 208/18
4,648,985 3/1987 Thorsell et al. ..... 252/35

*Primary Examiner*—Jacqueline V. Howard
*Attorney, Agent, or Firm*—Frishauf, Holtz, Goodman & Woodward

[57] ABSTRACT

A base oil for lubricating oil, a lubricating oil composition containing the base oil and a phenol-based antioxidant and/or organomolybdenum compound, and also an additive for a base oil for lubricating oil, consisting of a phenol-based antioxidant and an organomolybdenum compound are disclosed. The base oil and the lubricating oil composition containing the base oil are stable against $NO_x$ gas and are useful for use in internal combustion engines. The additive, when added to a base oil, provides a lubricating oil which is stable against $NO_x$ gas and can be used effectively in a $NO_x$ gas atmosphere.

17 Claims, No Drawings

BASE OIL FOR LUBRICATING OIL AND LUBRICATING OIL COMPOSITION CONTAINING SAID BASE OIL

BACKGROUND OF THE INVENTION

1. Field of the Invention

The present invention relates to a base oil for lubricating oil, a lubricating oil composition containing the base oil, and an additive for lubricating oil. More particularly, it is concerned with a base oil which is used as a lubricating oil stable in a nitrogen oxide ($NO_x$) gas atmosphere by itself, or is used to prepare such a stable lubricating oil in combination with suitable additives, a lubricating oil composition containing the above base oil, and further with an additive for the general base oil for lubricating oil.

The term "lubricating oil" as used herein means a lubricating oil for use in internal combustion engines.

2. Description of the Prior Art

In general, part of a combustion gas in internal combustion engines passes through between a piston and a cylinder, and leaks out into a crank case a a blow-by gas. Since this combustion gas contains a high concentration of $NO_x$ gas, it deteriorates a crank case oil (internal combustion engine oil).

In recent years, cars equipped with a reduction catalyst such as a three-way conversion catalyst as a countermeasure of exhausted gas regulations have been increasingly produced, and thus internal combustion engines are now operated under more severe conditions of high speed and high power. As a result, the concentration of $NO_x$ gas in combustion gas leaking out into the crank case tends to increase.

Moreover, from a viewpoint of energy saving, it is promoted to make the car body lighter, and thus the crank case is miniaturized. With this miniaturization, the amount of the crank case oil is decreased.

For the aforementioned reasons, the concentration of $NO_x$ gas in the crank case oil is markedly increased, and thus the crank case oil is greatly influenced by $NO_x$ gas. With the conventional internal combustion engine oils containing zinc dithiophosphate (Zn-DTP) and a detergent dispersant, abnormal degradation such as the formation of black sludge will occur in a short time.

Thus it has been desired to overcome the above problems and to provide a base oil or lubricating oil which is stable in a $NO_x$ gas atmosphere.

SUMMARY OF THE INVENTION

An object of the present invention is to provide a base oil which is stable in a $NO_x$ gas atmosphere and can be used as a stable lubricating oil for a long time.

Another object of the present invention is to provide a lubricating oil composition which is stable in a $NO_x$ gas atmosphere and can be used without degradation for a long time.

Still another object of the present invention is to provide an additive for the general base oil, which produces a lubricating oil stable in a $NO_x$ gas atmosphere.

Other objects and advantages of the present invention will become apparent from the following explanation.

The present invention relates to a base oil for lubricating oil, characterized by having a kinematic viscosity as determined at 100° C. of 2 to 50 centistokes (cSt), an aromatic content (% $C_A$) as determined by ring analysis of not more than 2% and a viscosity index of at least 75.

For convenience of explanation, this is hereinafter referred to as the "first invention".

The present invention further relates to a lubricating oil composition containing the base oil of the first invention and a phenol-based antioxidant and/or an organomolybdenum compound. This is hereinafter referred to as the "second invention".

The present invention further relates to an additive for the general base oil for lubricating oil, consisting of a phenol-based antioxidant and an organomolybdenum compound. This is hereinafter referred to as the "third invention".

DESCRIPTION OF PREFERRED EMBODIMENTS

The viscosity at 100° C. of the base oil of the first invention is in the range of 2 to 50 cSt, preferably 3 to 20 cSt. If the viscosity is less than 2 cSt, the evaporation loss is undesirably large. On the other hand, if it is in excess of 50 cSt, the power loss due to viscosity resistance is too large.

The aromatic content of the base oil of the first invention is not more than 2% and preferably not more than 1%. If the aromatic content is in excess of 2%, degradation in a $NO_x$ gas atmosphere is undesirably marked.

It is preferred for the base oil to have such characteristics as required for the usual lubricating oil to be used in internal combustion engines, for example, (1) proper viscosity characteristics, (2) good stability against oxidation, (3) good detergency and dispersancy, (4) good rust resistance and corrosion resistance, (5) good low temperature fluidity, and so forth. Specifically, it is more preferred for the base oil to have a viscosity index of at least 75, particularly at least 80, a sulfur content of not more than 100 ppm, particularly not more than 50 ppm, a total acid value of 0.1 mg KOH/g, and a pour point of not more than −10° C., particularly not more than −20° C., most preferably not more than −30° C.

As the base oil of the first invention, various mineral oils and synthetic oils can be used as long as they have the above specified properties.

Representative examples of the mineral oil which can be used as the base oil of the first invention include a purified oil which is obtained by purifying a distillate oil by the usual method, said distillate oil having been obtained by atmospheric distillation of a paraffin base crude oil or an intermediate base crude oil, or by vacuum distillation of a residual oil resulting from the atmospheric distillation, and a deep dewaxing oil which is obtained by subjecting the above purified oil to deep dewaxing treatment. In this case, the process for purification of the distillate oil is not critical, and various methods can be employed. Usually, the distillate oil is purified by applying such treatments as (a) hydrogenation, (b) dewaxing (solvent dewaxing or hydrogenation dewaxing), (c) solvent extraction, (d) alkali distillation or sulfuric acid treatment, and (e) clay filtration, alone or in combination with one another. It is also effective to apply the same treatment repeatedly at multi-stages. For example, (1) a method in which the distillate oil is hydrogenated, or after hydrogenation, it is further subjected to alkali distillation or sulfuric acid treatment, (2) a method in which the distillate oil is hydrogenated and then is subjected to dewaxing treatment, (3) a method in which the distillate oil is subjected to solvent extration treatment and then to hydrogenation treatment, (4) a method in which the distillate oil is subjected to two- or three-stage hydrogenation treatment, or after the two or three-stage hydrogenation treatment, it is further subjected to alkali distillation or sulfuric acid rinsing treatment, (5) a method in which after the treatment of the distillate oil by the methods (1) to (4) as described above, it is again subjected to dewaxing treatment to obtain a deep dewaxed oil, and so forth can be employed.

In the practice of the above methods, it suffices that processing conditions be controlled so that the resulting oil has a kinematic viscosity at 100° C. and an aromatic content both falling within the above-specified ranges.

A mineral oil obtained by deep dewaxing, i.e., deep dewaxed oil is particularly preferred as the base oil of the present invention. This deep dewaxing is carried out by solvent dewaxing under severe conditions, catalytic hydrogenation dewaxing using a Zeolite catalyst, and so forth.

As well as the aforementioned mineral oil, synthetic oils such as alkylbenzene, polybutene and poly(α-olefin), or mixtures thereof can be used as the base oil of the first invention.

The base oil of the first invention can be used as a lubricating oil for internal combustion engines by itself, because it exhibits sufficiently high stability against $NO_x$ gas. The stability of the base oil against $NO_x$ gas can be more increased by adding a phenol-based antioxidant and/or an organomolybdenum compound to the base oil.

Thus the second invention relates to a lubricating oil composition containing the base oil of the first invention and a phenol-based antioxidant and/or an organomolybdenum compound.

The phenol-based antioxidant to be used in the second invention is not critical and various compounds can be used. Representative examples of the phenol-based antioxidant are 4,4'-methylenebis(2,6-di-tert-butylphenol);
4,4'-bis(2,6-di-tert-butylphenol);
4,4'-bis(2-methyl-6-tert-butylphenol);
2,2'-methylenebis(4-ethyl-6-tert-butylphenol);
2,2'-methylenebis(4-methyl-6-tert-butylphenol);
4,4'-butylidenebis(3-methyl-6-tert-butylphenol);
4,4'-isopropylidenebis(2,6-di-tert-butylphenol);
2,2'-methylenebis(4-methyl-6-nonylphenol);
2,2'-isobutylidenebis(4,6-dimethylphenol);
2,2'-methylenebis(4-methyl-6-cyclohexylphenol);
2,6-di-tert-butyl-4-methylphenol;
2,6-di-tert-butyl-4-ethylphenol;
2,4-dimethyl-6-tert-butylphenol;
2,6-di-tert-α-dimethylamino-p-cresol;
2,6-di-tert-butyl-4(N,N'-dimethylaminomethylphenol);
4,4'-thiobis(2-methyl-6-tert-butylphenol);
4,4'-thiobis(3-methyl-6-tert-butylphenol);
2,2'-thiobis(4-methyl-6-tert-butylphenol);
bis(3-methyl-4-hydroxy-5-tert-butylbenzyl)sulfide;
bis(3,5-di-tert-butyl-4-hydroxybenzyl)sulfide, and the like.

The organomolybdenum compound to be used in the second invention is not critical and various compounds can be used. As representative examples of the organomolybdenum compound, molybdenum dithiocarbamate (MoDTC), molybdenum dithiophosphate (MoDTP), and the like, which have been used as extreme pressure agents, can be used.

The amount of the phenol-based antioxidant and/or the molybdenum compound compounded varies with the properties of the base oil, the type of the phenol-based antioxidant or organomolybdenum compound and so forth, and cannot be determined unconditionally.

Usually, the phenol-based antioxidant and/or the organomolybdenum compound is compounded in the following proportions.

When the phenol-based antioxidant alone is compounded, it is added in an amount of 0.05 to 3.0 parts by weight, preferably 0.1 to 2.0 part by weight per 100 parts by weight of the base oil. When the organomolybdenum compound alone is compounded, it is added in an amount of 0.05 to 3.0 parts by weight, preferably 0.1 to 2.0 part by weight, most preferably 0.1 to 1.5 parts by weight per 100 parts by weight of the base oil. Similarly, when the phenol-based antioxidant and the organomolybdenum compound are compounded, they are added so that the amount of each of the phenol-based compound and the organomolybdenum compound compounded is 0.05 to 3.0 parts by weight, preferably 0.1 to 2.0 part by weight, most preferably 0.1 to 1.5 parts by weight per 100 parts by weight of the base oil.

In the second invention, when both the phenol-based antioxidant and the organomolybdenum compound are compounded, there is obtained a lubricating oil composition which exhibits much higher stability against $NO_x$ gas than the compositions containing the phenol-based antioxidant or the organomolybdenum compound singly.

When both the phenol-based antioxidant and the organomolybdenum compound are compounded, they may be added in a suitable manner; for example, they are previously mixed and the resulting mixture is added to the base oil, or any one of them is first added to the base oil and then the other is added.

If necessary, various additives commonly used in the usual lubricating oil, such as Zn-DTP, a detergent dispersant, polymers and so forth, can be added to the base oil of the first invention and also to the lubricating oil composition of the second invention.

It has further been found that if a combination of a phenol-based antioxidant and an organomolybdenum compound is added to the general lubricating oil, the stability of the lubricating oil against $NO_x$ gas is increased.

Thus the third invention relates to an additive for lubricating oil, consisting a phenol-based antioxidant and an organomolybdenum compound.

As the phenol-based antioxidant and the organomolybdenum compound, the compounds described in the second invention can be used. The additive consisting of a phenol-based antioxidant and an organomolybdenum compound of the third invention can be added in a suitable manner; for example, the phenol-based antioxidant and the organomolybdenum compound are previously mixed and the resulting mixture is added, or any one of them is first added and then the other is added.

The amount of the additive compounded varies with the properties of the lubricating oil, the type of each of the phenol-based antioxidant and the organomolybdenum compound, and so forth, and cannot be determined unconditionally. Usually the additive is added in such a manner that the amount of each of the phenol-based antioxidant and the organomolybdenum compound compounded is 0.05 to 3.0 parts by weight, preferably 0.1 to 2.0 parts by weight per 100 parts by weight of the base oil.

As the base oil for lubricating oil, the stability against $NO_x$ gas of which can be improved by adding the additive of the third invention, those commonly used in the conventional lubricating oils, that is, mineral oil or synthetic oil having such properties as (1) proper viscosity characteristics, (2) good stability against oxidation, (3) good detergency and dispersancy, (4) good rust resistance and corrosion resistance, (5) good low temperature fluidity, and so forth can be used. More specifically, as the base oil for lubricating oil to be used in the third invention, the mineral oils and synthetic oils listed as the representative examples of the mineral oils and synthetic oils to be used in the first invention can be used.

In combination with the additive of the third invention, if necessary, other additives commonly used in the usual lubricating oil, such as Zn-DTP, a detergent dispersant, polymers and the like, can be added to the base oil for lubricating oil.

As described above, the base oil and the lubricating oil composition of the present invention are stable against $NO_x$ gas and can be used effectively as a lubricating oil for internal combustion engines high in the $NO_x$ gas concentration. They are useful not only as crank case oil for the usual gasoline engines and diesel engines but also as crank case oil for gas engines, that is, internal combustion engines using natural gas, liquefied petroleum gas (LPG), pyrolysis gas, coal decomposition gas, etc., as the fuel.

The additive of the present invention, when added to a base oil for lubricating oil, provides a lubricating oil stable against $NO_x$ gas. Thus the additive can be used effectively in the production of lubricating oil for internal combustion engines to be used in a high $NO_x$ gas atmosphere.

The present invention is described in greater detail with reference to the following examples.

EXAMPLES 1 to 7, and COMPARATIVE EXAMPLES 1 to 4

Lubricating oils were prepared by mixing the base oils and additives shown in Table 1.

These lubricating oil samples were subjected to the following $NO_x$ degradation test.

Into 50 ml of the above lubricating oil sample were blown nitrogen monoxide (NO) gas (concentration, 1%) and humidified air at rates of 6 l/hr and 10 l/hr, respectively, in the presence of an iron, copper catalyst (a test specimen specified in the oxidation test JIS K-2514). The temperature of the lubricating oil sample was maintained at 135° C., and a time in which abnormal degradation (abrupt increase in acid value) started was measured as the induction period.

The results are shown in Table 1.

TABLE 1

| Run No. | Composition of Lubricating Oil (parts by weight) | | | | | | $NO_x$ Degradation Test (Induction Period (hr)) |
|---|---|---|---|---|---|---|---|
| | Base Oil | | ATO*1 | MoDTC | MoDTP | Others*2 | |
| Comparative Example 1 | I*3 | 100 | — | — | — | 7.0 | 60 |
| Comparative Example 2 | II*4 | 100 | — | — | — | 7.0 | 65 |
| Example 1 | III*5 | 100 | — | — | — | 7.0 | 80 |
| Example 2 | III | 100 | 0.5 | | | 7.0 | 130 |
| Example 3 | III | 100 | 0.5 | 0.5 | — | 7.0 | 220 |
| Comparative Example 3 | I | 100 | — | 0.5 | — | 7.0 | 60 |
| Example 4 | III | 100 | — | 0.5 | — | 7.0 | 85 |
| Example 5 | III | 100 | 0.5 | — | 0.5 | 7.0 | 210 |
| Comparative Example 4 | IV*6 | 100 | — | — | — | — | 65 |
| Example 6 | I | 100 | 0.5 | 0.5 | — | 7.0 | 160 |
| Example 7 | II | 100 | 0.5 | 0.5 | — | 7.0 | 170 |

*1Phenol-based antioxidant (4,4'-methylenebis(2,6-ditert-butylphenol).

*2Containing Zn-DTP, a metal-based detergent, an ashless dispersant, a polymer and the like.

*3Solvent purification oil (kinematic viscosity at 100° C.: 4 cSt, viscosity index: 95, sulfur content: 500 ppm, aromatic content (% $C_A$): 8) obtained by subjecting a distillate oil from an intermediate base crude oil to solvent extraction-hydrogenation treatment.

*4Solvent purification oil (kinematic viscosity at 100° C.: 4 cSt, viscosity index: 100, sulfur content: 1000 ppm, aromatic content (% $C_A$): 4) obtained by subjecting a distillate oil from an intermediate base crude oil to solvent extraction-hydrogenation treatment.

*5Two-stage hydrogenated oil (kinematic viscosity at 100° C.: 4 cSt, viscosity index: 100, sulfur content: 1 ppm, aromatic content (% $C_A$): not more than 2) obtained by subjecting a distillate oil from an intermediate base crude oilto two-stage hydrogenation treatment.

*6Commercial available oil.

What is claimed is:

1. A base oil for lubricating oil, having a kinematic viscosity as determined at 100° C. of 2 to 50 cSt, an aromatic content of not more than 2%, a viscosity index of at least 75, a pour point not more than −10° C., and a sulfur content of not more than 100 ppm.

2. A base oil for lubricating oil, which is a deep dewaxed oil having a kinematic viscosity of 100° C. of 2 to 50 cSt, an aromatic content of not more than 2%, a viscosity index of at least 75, a pour point of not more than −20° C. and a suflur content of not more than 100 ppm.

3. A lubricating oil composition comprising a base oil having a kinematic viscosity as determined at 100° C. of 2 to 50 cSt and an aromatic content of not more than 2%, and a phenol-based antioxidant.

4. The composition as claimed in claim 3 wherein the amount of the phenol-based antioxidant compounded is from 0.05 to 3.0 parts by weight per 100 parts by weight of the base oil.

5. The composition as claimed in claim 3 wherein the amount of the phenol-based antioxidant compounded is from 0.05 to 2.0 parts by weight per 100 parts by weight of the base oil.

6. A lubricating oil composition comprising a base oil having a viscosity as determined at 100° C. of 2 to 50 cSt and an aromatic content of not more than 2%, and an organomolybdenum compound.

7. The composition as claimed in claim 6 wherein the amount of the organomolybdenum compound is from 0.05 to 3.0 parts by weight per 100 parts by weight of the base oil.

8. The composition as claimed in claim 6 wherein the amount of the organomolybdenum compound is from 0.05 to 2.0 parts by weight per 100 parts by weight of the base oil.

9. A lubricating oil composition comprising a base oil having a viscosity as determined at 100° C. of 2 to 50 cSt and an aromatic content of not more than 2%, a phenol-based antioxidant and an organomolybdenum compound.

10. The composition as claimed in claim 9 wherein the amount of each of the phenol-based antioxidant and the organomolybdenum compound is from 0.05 to 3.0 parts by weight per 100 parts by weight of the base oil.

11. The composition as claimed in claim 9 wherein the amount of each of the phenol-based antioxidant and the organomolybdenum compound is from 0.05 to 2.0 parts by weight per 100 parts by weight of the base oil.

12. The composition as claimed in claim 3 or 9 wherein the phenol-based antioxidant is at least one compound selected from 4,4'-methylenebis(2,6-di-tert-butylphenol);
4,4'-bis(2,6-di-tert-butylphenol);
4,4'-bis(2-methyl-6-tert-butylphenol);
2,2'-methylenebis(4-ethyl-6-tert-butylphenol);
2,2'-methylenebis(4-methyl-6-tert-butylphenol);
4,4'-butylidenebis(3-methyl-6-tert-butylphenol);
4'-isopropylidenebis(2,6-di-tert-butylphenol);
2,2'-methylenebis(4-methyl-6-nonylphenol);
2,2'-isobutylidenebis(4,6-dimethylphenol);
2,2'-methylenebis(4-methyl-6-cyclohexylphenol);
2,6-di-tert-butyl-4-methylphenol;
2,6.di-tert-butyl-4-ethylphenol;
2,4-dimethyl-6-tert-butylphenol;
2,6-di-tert-α-dimethylamino-p-cresol;
2,6-di-tert-butyl-4(N,N'-dimethylaminomethylphenol);
4,4'-thiobis(2-methyl-6-tert-butylphenol);
4,4'-thiobis(3-methyl-6-tert-butylphenol);
2,2'-thiobis(4-methyl-6-tert-butylphenol);
bis(3-methyl-4-hydroxy-5-tert-butylbenzyl)sulfide and
bis(3,5-di-tert-butyl-4-hydroxybenzyl)sulfide.

13. The composition as claimed in claim 6 or 9 wherein the organomolybdenum compound is at least one compound selected from molybdenum dithiocarbamate and molybdenum dithiophosphate.

14. The composition as claimed in claim 3, 6 or 9 wherein the base oil is a deep dewaxed oil having a kinematic viscosity at 100° C. of 2 to 50 cSt, an aromatic content of not more than 2%, a pour point of not more than −20° C. and a sulfur content of not more than 100 ppm.

15. An additive for a base oil for lubricating oil, consisting of a phenol-based antioxidant and an organomolybdenum compound.

16. The additive as claimed in claim 15 wherein the phenol-based antioxidant is at least one compound selected from 4,4'-methylenebis(2,6-di-tert-butylphenol);
4,4'-bis(2,6-di-tert-butylphenol);
4,4'-bis(2-methyl-6-tert-butylphenol);
2,2'-methylenebis(4-ethyl-6-tert-butylphenol);
2,2'-methylenebis(4-methyl-6-tert-butylphenol);
4'-butylidenebis(3-methyl-6-tert-butylphenol);
4,4'-isopropylidenebis(2,6-di-tert-butylphenol);
2,2'-methylenebis(4-methyl-6-nonylphenol);
2,2'-isobutylidenebis(4,6-dimethylphenol);
2,2'-methylenebis(4-methyl-6-cyclohexylphenol);
2,6-di-tert-butyl-4-methylphenol;
2,6-di-tert-butyl-4-ethylphenol;
2,4-dimethyl-6-tert-butylphenol;
2,6-di-tert-α-dimethylamino-p-cresol;
2,6-di-tert-butyl-4(N,N'-dimethylaminomethylphenol);
4,4'-thiobis(2-methyl-6-tert-butylphenol);
4,4'-thiobis(3-methyl-6-tert-butylphenol);
2,2'-thiobis(4-methyl-6-tert-butylphenol);
bis(3-methyl-4-hydroxy-5-tert-butylbenzyl)sulfide and
bis(3,5-di-tert-butyl-4-hydroxybenzyl)sulfide.

17. The additive as claimed in claim 15 wherein the organomolybdenum compound is at least one compound selected from molybdenum dithiocarbamate and molybdenum dithiophosphate.

* * * * *

UNITED STATES PATENT AND TRADEMARK OFFICE

CERTIFICATE OF CORRECTION

PATENT NO. : 4,812,246

DATED : March 14, 1989

INVENTOR(S) : T. YABE

It is certified that error appears in the above-identified patent and that said Letters Patent is hereby corrected as shown below:

Column 6, claim 4, line 2, delete "compounded".

Column 6, claim 5, line 2, delete "compounded".

Column 7, claim 12, line 10, replace "4'-isopropylidenebis" with --4,4'-isopropylidenebis--.

Column 8, claim 16, line 9, replace "4'-butylidenebis" with --4,4'-butylidenebis--.

Signed and Sealed this

Seventeenth Day of March, 1992

*Attest:*

HARRY F. MANBECK, JR.

*Attesting Officer*

*Commissioner of Patents and Trademarks*